US007279090B2

(12) United States Patent
Colyar et al.

(10) Patent No.: US 7,279,090 B2
(45) Date of Patent: Oct. 9, 2007

(54) INTEGRATED SDA AND EBULLATED-BED PROCESS

(75) Inventors: James J. Colyar, Newtown, PA (US); Stéphane Kressmann, Serezin du Rhone (FR); Christophe Gueret, Saint Romain en Gal (FR)

(73) Assignee: Institut Francais du Pe'trole (FR)

( * ) Notice: Subject to any disclaimer, the term of this patent is extended or adjusted under 35 U.S.C. 154(b) by 222 days.

(21) Appl. No.: 11/005,062

(22) Filed: Dec. 6, 2004

(65) Prior Publication Data

US 2006/0118463 A1 Jun. 8, 2006

(51) Int. Cl.
*C10G 47/00* (2006.01)
*C10C 3/00* (2006.01)

(52) U.S. Cl. ..... 208/108; 208/86; 208/39; 208/78; 208/107

(58) Field of Classification Search ..... 208/86, 208/108, 39, 78, 107
See application file for complete search history.

(56) References Cited

U.S. PATENT DOCUMENTS 4,062,758 A * 12/1977 Goudriaan et al. ..... 208/80
4,239,616 A * 12/1980 Gearhart ..... 208/309
4,317,711 A * 3/1982 Yan ..... 208/425
5,322,829 A * 6/1994 Artes et al. ..... 502/315
6,179,995 B1 * 1/2001 Cash et al. ..... 208/89
6,270,654 B1 * 8/2001 Colyar et al. ..... 208/57

* cited by examiner

*Primary Examiner*—Glenn Caldarola
*Assistant Examiner*—John C Douglas
(74) *Attorney, Agent, or Firm*—John F. Ritter

(57) ABSTRACT

This invention relates to a novel integrated method for economically processing vacuum residue from heavy crude oils. This is accomplished by utilizing a solvent deasphalter (SDA) in the first step of the process with a $C_3/C_4/C_5$ solvent such that the DAO product can thereafter be processed in a classic fixed-bed hydrotreater or hydrocracker. The SDA feed also includes recycled stripper bottoms containing unconverted residue/asphaltenes from a downstream steam stripper unit.

The asphaltenes from the SDA are sent to an ebullated-bed reactor for conversion of the residue and asphaltenes. Residue conversion in the range of 60-80% is achieved and asphaltene conversion is in the range of 50-70%. The overall residue conversion, with the DAO product considered non-residue, is in the range of 80 W %-90 W % and significantly higher than could be achieved without utilizing the present invention.

10 Claims, 1 Drawing Sheet

INTEGRATED SDA AND EBULLATED-BED PROCESS

TECHNICAL FIELD

This invention relates to a novel integrated method for economically processing atmospheric or vacuum residue from heavy crude oils. This is accomplished by utilizing a solvent deasphalter (SDA) in the first step of the process with a $C_3/C_4/C_5$ hydrocarbon solvent such that the deasphalted oil (DAO) yield can thereafter be processed in a classic fixed-bed hydrotreater/hydrocracker or in an ebullated-bed T-Star Unit. The SDA feed also includes recycled stripper bottoms from a downstream steam stripper unit. The second step involves ebullated-bed processing of the SDA asphaltenes where the asphaltenes are partially converted and upgraded.

DEFINITIONS

The term "asphaltenes" as used herein means a heavy polar fraction and are the residue which remains after the resins and oils have been separated from the feed residue fed to a deasphalting unit. Asphaltenes from vacuum resid are generally characterized as follows: a Conradson or Ramsbottom carbon residue of 15 to 90 weight % and a hydrogen to carbon (H/C) atomic ratio of 0.5 to 1.5. Asphaltenes can contain from 50 wppm to over 5000 wppm vanadium and from w20 ppm to over 2000 wppm nickel. The sulfur concentration of asphaltenes can be from 110% to 350% greater than the concentration of sulfur in the resid feed oil to the deasphalter. The nitrogen concentration of asphaltenes can be from 100% to 350% greater than the concentration of nitrogen in the resid feed oil to the deasphalter.

The terms "resid oil", "residue", and "resid" as used herein mean residual oil.

As used herein, the terms "solvent deasphalter", "SDA" "deasphalting unit" and "deasphalter" mean one or more vessels or other equipment which are used to separate atmospheric or vacuum resid into deasphalted oil ("DAO"), resins, and asphaltenes, by means of one or more solvents.

The term "deasphalted oil" (DAO) as used herein means oils that are generally the least dense products produced in a deasphalting unit and comprise saturate aliphatic, alicyclic, and some aromatic hydrocarbons. Deasphalted oil generally comprises less than 30% aromatic carbon and relatively low levels of heteroatoms except sulphur. Deasphalted oil from vacuum resid can be generally characterized as follows: a Conradson or Ramsbottom carbon residue of 1 to less than 12 weight % and a hydrogen to carbon (H/C) ratio of 1.0% to 2%. Deasphalted oil can contain 100 wppm or less, preferably less than 5 wppm, and most preferably less than 2 wppm, of vanadium and 100 wppm or less, preferably less than 5 wppm, and most preferably less than 2 wppm of nickel. The sulfur and nitrogen concentrations of deasphalted oil can be 90% or less of the sulfur and nitrogen concentrations of the resid feed oil to the deasphalter.

Hydrogen efficiency in a hydrogen addition upgrading process refers to a fraction of chemically consumed hydrogen which is used for heteroatom removal and for hydrogenation/saturation of liquid hydrocarbons.

BACKGROUND OF THE INVENTION

Hydrocarbon compounds are useful for a number of purposes. In particular, hydrocarbon compounds are useful, inter alia, as fuels, solvents, degreasers, cleaning agents, and polymer precursors. The most important source of hydrocarbon compounds is petroleum crude oil. Refining of crude oil into separate hydrocarbon compound fractions is a well-known processing technique.

Crude oils range widely in their composition and physical and chemical properties. In the last two decades, the need to process heavier crude oils has increased. Heavy crudes are characterized by a relatively high viscosity and low API gravity (generally lower than 25°) and high percentage of high boiling components (>950° F.).

Refined petroleum products generally have higher average hydrogen to carbon ratios on a molecular basis. Therefore, the upgrading of a petroleum refinery hydrocarbon fraction is classified into one of two categories: hydrogen addition and carbon rejection. Hydrogen addition is performed by processes such as hydrotreating and hydrocracking. Carbon rejection processes typically produce a stream of rejected high carbon material which may be a liquid or a solid; e.g., coke deposits.

Some carbon rejection processes such as FCC and coking include cracking of heavy molecules. Others such as solvent deasphalting consist only of physical separation of the lighter and heavier hydrocarbons. For instance, in solvent deasphalting of a heavy oil, a light solvent such as a $C_3/C_4/C_5$ hydrocarbon is used to dissolve or suspend the lighter hydrocarbons allowing the asphaltenes to be "precipitated". These phases are separated and then the solvent is recovered. Additional information on solvent deasphalting conditions, solvents and operations may be obtained from U.S. Pat. Nos. 4,239,616; 4,440,633; 4,354,922; and, 4,354,928, all of which are incorporated herein by reference.

To facilitate processing, heavy crudes or their fractions are generally subjected to thermal cracking or hydrocracking to convert the higher boiling fractions to lower boiling fractions, followed by hydrotreating to remove heteroatoms such as sulfur, nitrogen, oxygen and metallic impurities.

Further information on hydrotreating catalysts, techniques and operating conditions for residue feeds may be obtained by reference to U.S. Pat. Nos. 5,198,100; 4,810,361; 4,810,363; 4,588,709; 4,776,945 and 5,225,383 which are incorporated herein for this teaching.

Crude petroleums with greater amounts of impurities including asphaltenes, metals, organic sulfur and organic nitrogen require more severe processing to remove them. Generally speaking, the more severe the conditions required to treat a given feedstock (e.g. higher temperature and pressures), the greater the cost of overall plant.

In particular, asphaltenes produce high amounts of coke which deactivates the hydrotreating and hydrocracking catalysts. Asphaltenes also form precipitates and contain precipitate precursors which can greatly hinder subsequent processing.

Worldwide, fixed-bed reactors are still utilized considerably more than ebullated-bed reactors. The fixed-bed system is used for lighter, cleaner feedstocks and is a relatively simple and well understood system. Fixed-bed systems are used mostly for naphtha, mid-distillate, atmospheric and vacuum gas-oils, and atmospheric residua treatment.

However, as the feedstock becomes heavier, has a greater level of impurities, or requires more severe conversion levels, the fixed-bed system becomes less effective and efficient. In these cases, the ebullated-bed reactor systems are better suited for processing.

In general, ebullated-bed reactors are utilized to process heavy crude oil feed streams, particularly those feeds with high metals and CCR. The ebullated-bed process comprises the passing of concurrently flowing streams of liquids, or slurries of liquids and solids, and gas through a vertically elongated fluidized catalyst bed. The catalyst is fluidized and completely mixed by the upwardly flowing liquid streams. The ebullated-bed process has commercial application in the conversion and upgrading of heavy liquid hydrocarbons and converting coal to synthetic oils.

The ebullated-bed reactor and related process is generally described in U.S. Pat. No. 25,770 to Johanson incorporated herein by reference. A mixture of hydrocarbon liquid and hydrogen is passed upwardly through a bed of catalyst particles at a rate such that the particles are forced into random motion as the liquid and gas pass upwardly through the bed. The catalyst bed motion is controlled by a recycle liquid flow so that at steady state, the bulk of the catalyst does not rise above a definable level in the reactor. Vapors, along with the liquid which is being hydrogenated, pass through the upper level of catalyst particles into a substantially catalyst free zone and are removed from the upper portion of the reactor.

Ebullated-bed reactors are generally operated at relatively high temperatures and pressures in order to process these heavy feedstocks. Since such operating parameters substantially increase the cost of designing and constructing the reactors, it would therefore be advantageous to have a system wherein the overall design and manufacturing costs were optimized for specific feedstocks or feedstock components. This optimization would result in a lower initial investment and lower annual operating costs. Moreover, there is always a need to design process systems that convert greater amounts of feedstock into high quality products.

SUMMARY OF THE INVENTION

The object of this invention is to provide a new integrated SDA/ebullated-bed process for economically converting and/or upgrading heavy vacuum residue from heavy crudes.

It is another object of this invention to provide an integrated SDA/ebullated-bed process in which the deasphalted oil (DAO) from the solvent deasphalter can be processed in a classic fixed-bed hydrotreater/hydrocracker or in an ebullated-bed T-Star Unit.

It is a further object of the invention to provide an integrated SDA/ebullated-bed process that utilizes a wide pore catalyst for maximum efficiency.

It is yet a further object of the invention to provide a integrated SDA/ebullated bed process that utilizes stripper bottoms recycle blended with straight run vacuum residue, thereby acting as a peptizing agent for the unconverted asphaltenes and minimizing the chance of asphaltene precipitation and subsequent fouling.

A novel feature of this invention is the novel utilization of a solvent deasphalter ("SDA") during the initial processing of the vacuum resid feedstock to separate it into DAO and asphaltenes. The DAO can thereafter be further processed at lower temperature and pressures in a classical fixed-bed hydrotreater or T-Star Unit while the asphaltenes are processed through at least one ebullated-bed hydrocracker for conversion of residue and asphaltenes.

More particularly, the present invention describes an integrated process for attaining a high degree of vacuum residue conversion, comprising the steps of:

a) feeding a vacuum resid oil feedstock, 90% of said feedstock boiling above 975° F., along with steam stripper bottoms from a downstream steam stripper, to a solvent deasphalter ("SDA") to provide an asphaltene stream and a deasphalted oil stream;
b) processing said asphaltene stream through one or more ebullated-bed reactors in series to produce an ebullated-bed reactor product stream;
c) separating said ebullated-bed reactor product stream in a hot high pressure separator to provide a gas phase product and a liquid phase product,
d) processing said liquid phase product through a steam stripper to produce a stripper overhead effluent and a stripper bottoms effluent;
e) recycling a portion of the said stripper bottoms effluent for combining with said vacuum resid feedstock from step (a) prior to feeding combined feedstream into said SDA; and
f) processing said deasphalted oil stream through a classical fixed-bed reactor for hydrotreatment/hydrocracking or through an ebullated-bed.

DETAILED DESCRIPTION OF THE INVENTION

Figure 1:
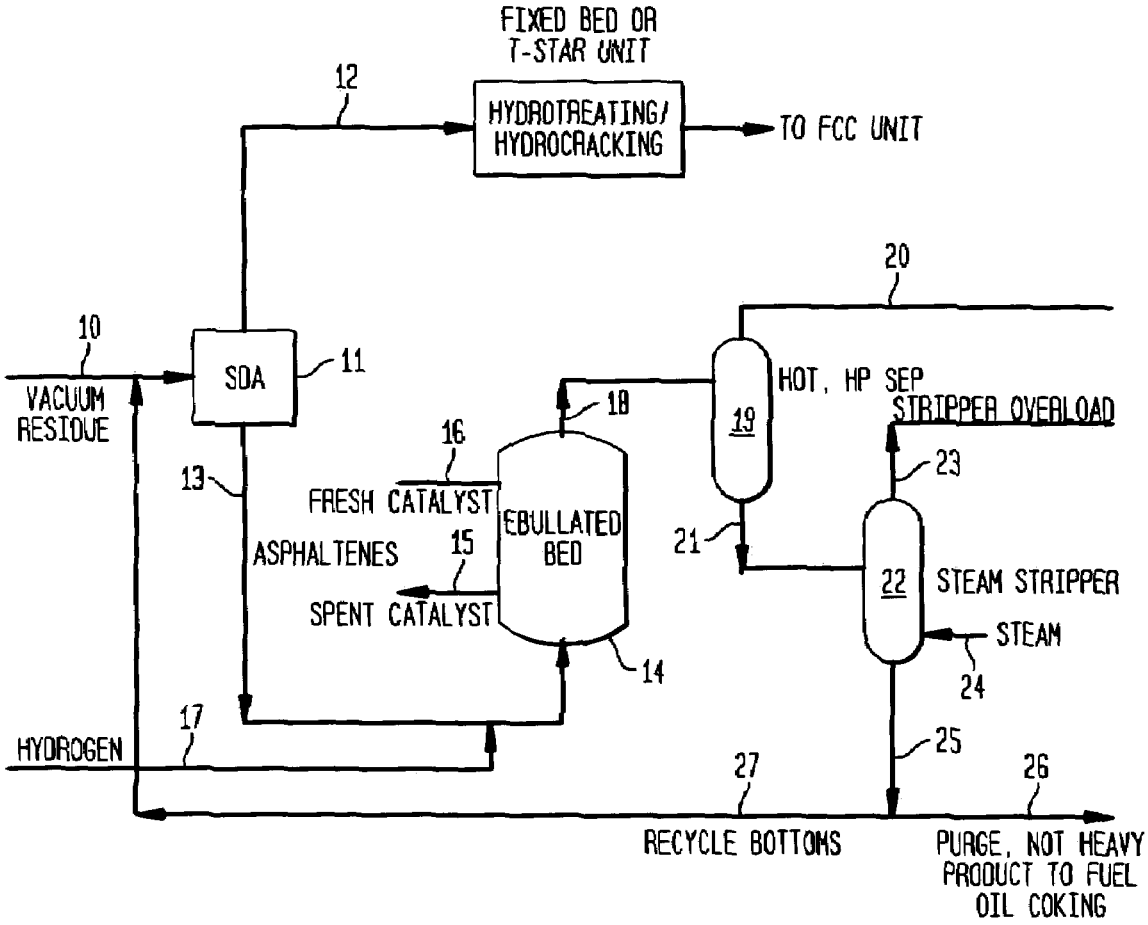
FIG. 1 shows a schematic flowsheet of the vacuum residue hydroconversion process.

FIG. 1 shows a schematic flowsheet of the atmospheric or vacuum resid hydroconversion process. Resid feedstock is provided at 10 and fed into a solvent deasphalting separator ("SDA") 11 where it is separated into deasphalted oil ("DAO") stream 12 and an asphaltene stream 13.

The solvent utilized in the SDA unit 11 may be any suitable hydrocarbonaceous material which is a liquid within suitable temperature and pressure ranges for operation of the countercurrent contacting column, is less dense than the feed stream 10, and has the ability to readily and selectively dissolve desired components of the feed stream 10 and reject the asphaltic materials also commonly known as pitch. The solvent may be a mixture of a large number of different hydrocarbons having from 3 to 14 carbon atoms per molecule, such as a light naphtha having an end boiling point below about 200° F. (93° C.).

Preferably, the SDA unit 11 is operated with a $C_3/C_4/C_5$ solvent to obtain a high lift (high DAO yield) such that the DAO can be treated in a classic fixed-bed reactor or in an ebullated-bed T-Star Unit. More specifically, the solvent may be a relatively light hydrocarbon such as ethane, propane, butane, isobutane, pentane, isopentane, hexane, heptane, the corresponding mono-olefinic hydrocarbons or mixtures thereof. Preferably, the solvent is comprised of paraffinic hydrocarbons having from 3 to 7 carbon atoms per molecule and can be a mixture of 2 or more hydrocarbons. For instance, a preferred solvent may be comprised of a 50 volume percent mixture of normal butane and isopentane.

The solvent deasphalting conditions include a temperature from about 50° F. (10° C.) to about 600° F. (315° C.) or higher, but the deasphalter 11 operation is preferably performed within the temperature range of 100° F. (38° C.)-400° F. (204° C.). The pressures utilized in the solvent deasphalter 11 are preferably sufficient to maintain liquid phase conditions, with no advantage being apparent to the use of elevated pressures which greatly exceed this minimum. A broad range of pressures from about 100 psig (689 kPag) to 1000 psig (6895 kPag) are generally suitable with a preferred range being from about 200 psig (1379 kPag) to 600 psig (4137 kPag).

An excess of solvent to charge stock should preferably be maintained. The solvent to charge stock volumetric ratio should preferably be between 2:1 to about 20:1 and preferably from about 3:1 to about 9:1. The preferred residence time of the charge stock in the solvent deasphalter 11 is from about 10 to about 60 minutes.

The resulting deasphalted oil steam 12 produced in the solvent deasphalter 11 is introduced into a classical fixed-bed hydrotreater reactor or T_Star Unit where it is processed to reduce contaminant levels and increase hydrogen content. The product from a DAO hydrotreater can be fed to a FCC unit for production of naphtha and eventually gasoline blending stock. For a $C_3/C_4$ solvent, the DAO hydrotreater is a fixed-bed reactor type and operates at conditions similar to those used to treat a heavy vacuum gas oil feedstock. For a $C_5$ solvent, it may be optimal to utilize an ebullated-bed T-Star process Unit to hydrotreat/hydrocrack the DAO. $C_5$ DAO will have higher levels of contaminants, particularly CCR and metals, and is a difficult feed for a fixed-bed system. However, such a feedstream is typical for an ebullated-bed T-Star Unit and it is illustrative of the post-SDA processing of the DAO stream 12.

The fixed-bed hydrotreatment units upgrade the feedstock of which 90 wt. % of the compounds have an initial boiling point above 650° F. (343° C.) and an end boiling point above 1110° F. (599° C.), preferably above 1290° F. (699° C.)

Although not shown in the drawing, the deasphalted oil 12 from the solvent deasphalter 11 can be blended or not with one or more additional feeds. The term "feeds" as used herein means an external feed to the process according to the invention, the recycled portion of the effluent from the fixed-bed reactor, or an effluent from the ebullated-bed reactor including, but not limited to, vacuum gas oil and diesel.

These external feeds can be straight run vacuum distillates, straight run diesel, and/or vacuum distillates from a conversion process such as coking. Additionally, the feeds may be from fixed-bed hydroconversion such as those from an Hyvahl Pocess, or from an ebullated-bed such as those from H-Oil™ Process, or from another solvent deasphalter.

The blend can also contain light cycle oil (LCO) of various origins, heavy cycle oil (HCO) of various origins and effluents from catalytic cracking located after the fixed-bed reactor used as described herein. The blend may also contain aromatic extracts or parrafins obtained from the manufacture of lubricating oils. Further, the blend processed through the fixed-bed post-treatment process can also be formed by mixing those various fractions in any proportions.

Regardless of whether the DAO stream 12 is solely DAO or a blend as described above, the stream enters the fixed-bed reactor contains generally less than 3000 wppm of asphaltenes (insoluble in heptane) and less than 50 wppm of metals. Preferably, the stream contains less than 6000 wppm of asphaltenes (insoluble in heptane) and less than 100 wppm of metals. Even more preferably, the stream contains less than 500 wppm of asphaltenes and less than 10 wppm of metals. A guard bed or reactor located before the fixed-bed of hydroprocessing catalyst allows the reduction of asphaltenes content, as well as the reduction of metal content.

The combined fixed-bed feedstream can be partially cracked in at least one reactor bed in the presence of hydrogen to obtain one stream containing a gasoline fraction, a jet fuel fraction, a diesel fraction and an unconverted fraction. The unconverted fraction can be treated in an FCC unit or steam cracking unit, or in another embodiment it can be treated by dewaxing (catalytic dewaxing preferably) followed by hydrofinishing to produce base oil. Optionally, a solvent extraction unit can be located before the catalytic dewaxing step.

The term "hydrocracking step" as used herein encompasses fixed-bed cracking processes comprising at least one reactor containing at least one bed of cracking catalyst under cracking conditions in the presence of hydrogen for producing an effluent with a reduced sulfur content and a higher middle distillates content.

The operating conditions used in the hydrocracking step allow conversion of the feed to products boiling below 650° F. (343° C.), preferably below 700° F. (371° C.) above 5 wt % and preferably between 10 and 100 wt %. The term fixed-bed "hydrocracking" means fixed bed FCC feed pre-treating and mild hydrocracking to prepare FCC feed, fixed-bed hydrorefining to produce base oils after dewaxing and the conventional fixed-bed high pressure hydrocracking to produce middle distillates, or middle distillates and base oils after dewaxing.

The conventional fixed-bed hydrocracking comprises the single-stage configuration with an initial hydrotreatment step to reduce the nitrogen and sulfur contents of the feed before being processed by the hydrocracking catalyst, particularly using a zeolithic containing catalyst. The conventional hydrocracking also comprises a two-stage configuration with a separation step between the first and the second stages.

The catalysts generally used in the hydrocracking process comprise at least an amorphous mineral support and at least one metal or metal compound with a dehydro-hydrogenating function (generally at least one element from group VIB and VIII) and optionally a zeolite (generally zeolite Y). Moreover, the support can, for example, be selected from the group formed by alumina, silica, silica-aluminas, magnesia, clays and mixtures of at least two of these minerals.

Further, the catalyst in this post-SDA hydrocracking step can be amorphous (i.e. without containing zeolite) or zeolitic. When zeolitic catalyst is used, the feed is pretreated over a hydrotreatment catalyst bed before reaching the hydrocracking catalyst bed.

As mentioned above, if the asphaltenes content is higher, fixed-bed hydrotreaters or hydroprocessors can be equipped with a demetallation bed-guard or preceded by a guard reactor, preferably permutable reactors as described in U.S. Pat. No. 6,306,287 in order to reduce metal content of the combined feedstream before processing on hydrotreatment or hydrocracking catalysts.

A temperature of approximately 625° F. (329° C.) to 840° F. (449° C.), normally 680° F. (360° C.) to 825° F. (440° C.) is used with an absolute pressure of 580 to 3625 psi (4 to 25 MPa), although it could also range between 580 to 1160 psi (4 to 8 MPa). Preferrably, the pressure is greater than 1160 psi (8 MPa) and up to 1740 psi (12 MPa), and optionally it is greater than 1740 psi (12 MPa) and up to 3625 psi (25 MPa), depending on the feed and on product specifications.

The liquid hourly space velocity (LHSV) and partial pressure of hydrogen are important factors which are selected depending on the characteristics of the feed to be treated and the desired conversion. The liquid hourly space velocity (LHSV) is about 0.1 to about 6 $hr^{-1}$, normally about 0.2 to about 3 $hr^{-1}$. The quantity of hydrogen mixed with the feed is usually about 600 to 12,000 SCF/Bbl of liquid feed (100 to about 2000 normal cubic meters ($Nm^3$) per cubic meter ($m^3$) of liquid feed).

In the case where the hydrocracking step is a FCCU feed pre-treating or mild hydrocracking process, at least a portion of the heavy fraction of the hydrotreated feed after fractionation can be sent to a conventional catalytic cracking section in which it is conventionally catalytically cracked under conditions which are well known to the skilled person to produce a fuel fraction (comprising a gasoline fraction and a diesel fraction).

As described herein, the expression "catalytic cracking" encompasses cracking processes comprising at least one partial combustion regeneration step and those comprising at least one total combustion regeneration step and those comprising at least one total combustion regeneration step and/or those comprising both at least one partial combustion step and at least one total combustion step. A full description of the catalytic process can be found in U.S. Pat. No. 6,153,087.

In the case where the hydrocracking step is to produce base oils, at least a portion of the heavy fraction of the hydrotreated feed after fractionation can be sent to a solvent or a dewaxing step followed by a hydrofinishing step. Preferably a catalytic dewaxing followed by a hydrofinishing step is used.

In the case where a $C_5$ or heavier solvent is utilized in the SDA Unit, the resulting DAO stream will be heavier and contain high levels of CCR and contaminant metals. In this situation, it is typically more prudent to send the DAO to an Ebullated-bed for hydrotreatment/hydrocracking. The Ebullated-bed T-Star Process is used in the description that follows.

The decision to utilize a fixed-bed or ebullated-bed reactor design is based on a number of criteria including type of feedstock, desired conversion percentage, flexibility, run length, product quality, etc. From a general standpoint, the ebullated-bed reactor was invented to overcome the plugging problems with fixed-bed reactors as the feedstock becomes heavier and the conversion (of vacuum residue) increases. In the ebullated-bed reactor, the catalyst is fluid, meaning that it will not plug-up as is possible in a fixed-bed. The fluid nature of the catalyst in an ebullated-bed reactor also allows for on-line catalyst replacement of a small portion of the bed. This results in a high net bed activity, which does not vary with time.

Fixed-bed technologies have problems in treating particularly heavy charges containing high percentages of heteroatoms, metals and asphaltenes, as these contaminants cause the rapid deactivation of the catalyst and subsequent plugging of the reactor. One could utilize numerous fixed-bed reactors connected in series to achieve a relatively high conversion of such heavy vacuum gas oil or $C_5$ DAO feedstocks, but such designs would be costly and, for certain feedstocks, commercially impractical.

Therefore, as mentioned above, to treat these charges, ebullated-bed technologies have been developed and sold, which have numerous advantages in performance and efficiency, particularly with heavy crudes. This process is generally described in U.S. Pat. No. Re 25,770 to Johanson, incorporated herein by reference.

The ebullated-bed process comprises the passing of concurrently flowing streams of liquids or slurries of liquids and solids and gas through a vertically cylindrical vessel containing catalyst. The catalyst is placed in motion in the liquid and has a gross volume dispersed through the liquid medium greater than the volume of the mass when stationary. This technology is utilized in the upgrading of heavy liquid hydrocarbons or converting coal to synthetic oils.

A mixture of hydrocarbon liquid and hydrogen is passed upwardly through a bed of catalyst particles at a rate such that the particles are forced into motion as the liquid and gas pass upwardly through the bed. The catalyst bed level is controlled by a recycle liquid flow so that at steady state, the bulk of the catalyst does not rise above a definable level in the reactor. Vapors, along with the liquid which is being hydrogenated, pass through the upper level of catalyst particles into a substantially catalyst-free zone and are removed at the upper portion of the reactor.

In an ebullated-bed process, the substantial amounts of hydrogen gas and light hydrocarbon vapors present rise through the reaction zone into the catalyst-free zone. Liquid is both recycled to the bottom of the reactor and removed from the reactor as net product from this catalyst-free zone. Vapor is separated from the liquid recycle stream before being passed through the recycle conduit to the recycle pump suction. The recycle pump (ebullating pump) maintains the expansion (ebullation) of the catalyst at a constant and stable level. Gases or vapors present in the recycled liquid materially decrease the capacity of the recycle pump as well as reduce the liquid residence time in the reactor and limit hydrogen partial pressure.

Reactors employed in a catalytic hydrogenation process with an ebullated-bed of catalyst particles are designed with a central vertical recycle conduit which serves as the downcomer for recycling liquid from the catalyst-free zone above the ebullated catalyst bed to the suction of a recycle pump to recirculate the liquid through the catalytic reaction zone. Alternatively, the ebullating liquid can be obtained from a vapor separator located just downstream of the reactor or obtained from an atmospheric stripper bottoms. The recycling of liquid serves to ebullate the catalyst bed, maintain temperature uniformity through the reactor and stabilize the catalyst bed. Typical conditions in the Ebullated-bed T-Star Process for processing a $C_5$ or heavier DAO feedstock are shown below.

TABLE 1

| Condition | Broad | Preferred |
|---|---|---|
| Reactor LHSV (liquid hourly space velocity), $hr^{-1}$ | 0.3-3.0 | 0.5-2.0 |
| Reactor Temperature ° F. | 700-850 | 740-840 |
| Reactor total pressure, psig | 500-3,500 | 800-2,000 |
| Reactor outlet hydrogen partial pressure, psi | 400-2,000 | 500-1,500 |
| Reactor superficial gas velocity, fps | 0.02-0.30 | 0.025-0.20 |
| Catalyst Replacement Rate, lb/bbl | 0.03-0.5 | 0.05-0.30 |
| Catalyst bed expansion, % | 10-40 | 15-25 |

Suitable hydrogenation catalysts for the ebullated-bed T-Star reactor include catalysts containing nickel, cobalt, palladium, tungsten, molybdenum and combinations thereof supported on a porous substrate such as silica, alumina, titania, or combinations thereof having a high surface to volume ratio. Typical catalytically active metals utilized are cobalt, molybdenum, nickel and tungsten; however, other metals or compounds could be selected dependent on the application.

As previously mentioned the above describes the processing of the DAO stream 12 and/or a blend thereof. The SDA, however, also creates an asphaltenes stream 13. The aphaltenes stream 13 are thereafter fed into a residual feedstock ebullated-bed unit 15 along with make-up and recycle hydrogen provided at 17. The ebullated-bed unit 15 is typically operated at greater than 2,500 psi total pressure. While the schematic flowsheet in the drawing herein shows a single ebullated-bed processing system, two or more ebullated-bed reactors in series can be utilized.

Fresh make-up catalyst can be added to the catalyst bed in ebullated-bed reactor 14 through connection 16, and an equivalent amount of spent catalyst is withdrawn from the ebullated-bed reactor 14 at connection 15. For a high metals feedstock, it is preferable to use a wide pore extrudate catalyst since it can provide a high level of asphaltene conversion and contaminant metals retention. The characteristics of useful catalyst are shown in Table 2 below.

The ebullated-bed reactor effluent 18 is subsequently passed through the external hot, high pressure separator ("HHPS") 19 wherein it is separated into gas and liquid phases. The gas phase, comprised largely of hydrogen and gaseous and vaporized hydrocarbons is drawn off by line 20 and thereafter conventionally treated to recover hydrogen, hydrocarbon gases, etc. Although not shown here, it is typical to utilize the separated purified hydrogen as part of the hydrogen feed 17 to the system.

The net liquid phase drawn from the HHPS 19 through line 21 is sent to a steam stripper 22. Steam is supplied to the atmospheric steam stripper through line 24. Stripper bottoms products (nominal 650° F.$^+$ boiling) are drawn off to the battery limits at line 25 and can be purged for combustion, coking, or heavy fuel oil production through line 26. A portion (approximately 35%-50%) of the stripper bottoms are recycled back via stream 27 to the vacuum residue feedstream 10 prior to being fed to the SDA unit 11. The quantity of recycled stripper bottoms 27 controls the net vacuum resid conversion level of the overall integrated process.

Moreover, the recycled stripper bottoms 27, when combined with the vacuum residue feedstock 10 acts as a peptizing agent for the unconverted asphaltenes, thus minimizing the risk of asphaltene precipitation and fouling. Unconverted asphaltenes in the recycled stripper bottoms 27 will be separated in the SDA 11 and will be partially converted in the ebullated-bed reactor 14. This increases the overall vacuum residue conversion level and decreases the net yield of the lowest quality, lowest value product.

Overhead product from steam stripper 22 is drawn of by line 23 and sent to downstream product fractionation for final production of naphtha, diesel, and vacuum gas oil streams. These streams are thereafter routed to final product treatment. Optionally, the gas oil products the ebullated-bed can be further processed, along with the DAO, in the previously described fixed-bed or T-Star hydrotreater or hydrocracker.

The ebullated-bed reactor 14 processing the asphaltenes is maintained at broad reaction conditions as shown in the Table 3 below:

TABLE 1

USEFUL CATALYST CHARACTERISTICS

| Catalyst Characteristic | Broad | Preffered |
|---|---|---|
| Particle Diameter, in. | 0.025-0.083 | 0.030-0.065 |
| Particle Diameter, nm. | 0.6-2.1 | 0.75-1.65 |
| Bulk Density, lb/ft$^3$ | 25-50 | 30-45 |
| Particle Crush Strength, lb/mm | 1.8 min | 2.0 min |
| Total Active Metals Content, wt % | 2-25 | 5-20 |
| Total Pore Volume, cm$^2$/gm* | 0.3-1.5 | 0.40-1.2 |
| Total Surface Area, m$^2$/gm | 100-400 | 150-350 |
| Average Pore Diameter, Angstrom** | 50-350 | 80-250 |

*Determined by mercury penetration method at 60,000 psi pressure

**Average pore diameter calculated by $ADP = \frac{4\ \text{Pore Volume}}{\text{Surface Area}} \times 104$

TABLE 2

EBULLATED-BED REACTOR - Asphaltene Feed

| Condition | Broad | Preferred |
|---|---|---|
| Feedstock Residue Content, vol. % 975° F.+ | 50-100 | 80-100 |
| Overall Reactor LHSV (liquid hourly space velocity), hr−1 | 0.1-1.0 | 0.2-0.5 |
| Reactor Temperature ° F. | 700-850 | 770-820 |
| Reactor total pressure, psig | 500-3500 | 2,500-3,000 |
| Reactor outlet hydrogen partial pressure, psi | 1500-2,500 | 1,800-2,100 |
| Catalyst Replacement Rate, lb/bbl | 0.03-1.0 | 0.05-0.60 |

Relative to conventional processing configurations, this novel processing scheme, combined with the utilization wide pore ebullated-bed catalyst, attains a high level of residue conversion of heavy crude vacuum residue to distillates and DAO at a minimal total plant investment.

Two examples which clearly illustrate the advantages of the invention are discussed below. The first example involves the use of a $C_5$ solvent in the SDA unit, resulting in a substantial DAO yield. The quality of the DAO however is such that an ebullated-bed T-Star unit is specified to hydrotreat/hydrocrack the DAO. In the second example, a $C_4$ solvent is utilized in the SDA unit and the DAO is thereafter processed in a classical fixed-bed hydrotreater/hydrocracker.

EXAMPLE 1

Further understanding of the present invention is illustrated in the following example as described below. A vacuum residue feedstock derived from a Western Canadian heavy crude is processed in order to produce distillate material and a heavy fuel oil. Because of the heavy nature (high CCR and metals) of this crude, an ebullated-bed reactor is utilized.

This example will illustrate and compare conventional processing and processing incorporating this invention. The Western Canadian vacuum residue has the following inspections (Table 4) and yields/qualities when processed in a $C_5$ solvent utilizing SDA unit.

TABLE 3

| | Vacuum Residue | Asphaltenes | $C_5$ DAO |
|---|---|---|---|
| W % | 100 | 42.1 | 57.9 |
| Gravity, °API | 3.0 | −5.7 | 9.3 |
| Residue Content (975° F.), Wt. % | 94 | 100 | 90 |
| Nitrogen, Wt. % | 0.62 | 0.85 | 0.42 |
| Sulfur, wt. % | 5.53 | 7.36 | 4.2 |
| CCR, W % | 24 | 40 | 10 |
| Nickel, wppm | 115 | 230 | 30 |
| Vanadium, Wppm | 270 | 550 | 70 |
| $C_7$ insolubles, W % | 17 | 40 | Less than 50 wppm |

In a pre-invention processing configuration, all of the vacuum residue is sent to an ebullated-bed reactor system and a typical maximum conversion of 65 V % is obtained. Typical product rates and required ebullated-bed reactor volume is shown in Table 5.

Also shown in Table 5 is the ebullated-bed results for the present invention. In this case, the ebullated-bed processes the SDA $C_5$ asphaltenes and the federate is substantially lower. For the example shown, the federate to the ebullated-bed is 39.4 Bbl versus 100 Bbl for the pre-invention case. The current invention operates at a 65 V % conversion using reactors slightly smaller than in pre-invention cases. The yield of ebullated-bed distillates plus VGO is 28.5 Bbl versus 71.9. Bbl for the pre-invention case.

TABLE 5

EBULLATED-BED YIELDS AND REACTOR VOLUME REQUIREMENTS

| | Pre-Invention | Present Invention |
|---|---|---|
| Feedrate of Vacuum Residue, Bbl | 100 | 100 |
| Feedrate to Ebullated-bed, Bbl | 100 | 39.4 |
| Feed to Ebullated-bed | Vacuum residue | Asphaltenes |
| Residue conversion in ebullated-bed, V % | 65 | 65 |
| Yield from ebullated-bed, Bbl | | |
| Naphtha | 14.3 | 6.5 |
| Diesel | 24.6 | 9.1 |
| Gas Oil | 33.4 | 12.9 |
| Vacuum residue | 32.7 | 28.5 |
| Total distillates plus VGO | 71.9 | 28.5 |
| Reactor Requirement, $Ft^3$ | V | <V |

TABLE 6

Net Yields - Basis 100 Bbl of Vacuum Residue Feed

| | Pre-Invention | Present Invention |
|---|---|---|
| Distallates, Bbl | 71.9 | 28.5 |
| $C_5$ DAO, Bbl | 0 | 60.6 |
| Total Distillates plus DAO, Bbl | 71.9 | 89.1 |
| Net Conversion, V % | 65.0 | 85.2 |

As shown in Table 6, the invention results in a higher overall conversion of the vacuum residue (85.2 V % versus 65 V %) and greatly improved distillate yield (89.1 V % vs. 71.9 V %). This improvement in overall process performance is accomplished in this example by using a total reactor volume approximately equal to the pre-invention design.

The $C_5$ DAO in this example contains 100 wppm metals and 10 W % CCR. This stream is routed to an ebullated-bed T-Star Unit for hydrotreating/hydrocracking.

EXAMPLE 2

An atmospheric residue feedstock derived from a heavy crude is distilled into a vacuum gas oil (14 w %) and a vacuum residue (86 w %).

The vacuum residue has the following inspections and yields/qualities when processed in a SDA unit using a C4 solvent.

| | Vacuum Residue | Pure C4 DAO | C4 DAO + vacuum gasoil | Asphaltenes |
|---|---|---|---|---|
| W % | 100 | 53 | — | 47 |
| W % to the atmospheric residue | 86 | 45.6 | 59.6 | 40.4 |
| Residue content (975° F.+), w % | 94 | 90.0 | 68.8 | 100 |
| Specific Gravity | 1.06 | 0.9880 | 0.98 | 1.114 |
| Sulfur, wt % | 5.7 | 4.0 | 3.6 | 6.3 |
| Nitrogen, wt % | 6800 | 3000 | 2400 | 9950 |
| CCR, wt % | 25 | 6.4 | 5 | 45 |
| Nickel, wppm | 110 | 15 | 10 | 215 |
| Vanadium, wppm | 270 | 22 | 15 | 495 |
| C7 insolubles, w % | 15 | <500 wppm | <500 wppm | 31 |

In the present invention the asphaltenes are sent to an ebullated-bed reactor system while the C4 DAO is mixed with the vacuum gas oil to be processed in a fixed bed mild hydrocracking unit.

The ebullated-bed reactor used is composed of two reactors using NiMo catalyst. The operating conditions are the following:

total pressure: 2900 psi (20 MPa)

LHSV=0.3 $hr^{-1}$

H2 to hydrocarbon ratio=4,000 scf/Bbi (600 $Nm^3/m^3$)

The conversion level of the 975° F.+ fraction in the ebullated step is 69%. The slate of yield is the following:

| Yields slate | wt % |
|---|---|
| Naphtha, w % of the feed | 12 |
| Diesel, w % of the feed | 19 |
| Vac. Gasoil, wt % to the feed | 30 |
| Residue, wt % to the feed | 31 |

The fixed bed catalyst is a typical NiMo catalyst on alumina, for example HR448 catalyst from AXENS in order to produce a feed for a FCC unit. In this configuration a catalyst, for example HMC841 catalyst from AXENS, is used as a guard bed to demetalize the feed before to be sent to the mild hydrocracking catalyst.

The operating conditions are the following:

HR448 LHSV=1.0 $hr^{-1}$

HMC841 LHSV=10. $hr^{-1}$

H2 partial pressure=1300 psi (9 MPa)

H2 to hydrocarbons ratio=4,800 scf/Bbi (700 $Nm^3/m^3$)

The conversion of the 700° F.+ fraction in the mild hydrocracking step is 13 w %. The slate of yields and the quality of the hydrotreated feed (700° F.+ fraction) are shown in the following table.

| Yields and products qualities | |
|---|---|
| Naphtha, w % of the feed | 1.3 |
| Gasoil, w % to the feed | 8.4 |
| Residue (700° F.+ fraction), w % to the feed | 87.0 |
| Sulfur content, wppm | 2,100 |
| Nitrogen content, wppm | 900 |
| Carbon Conradson content, w % | 1.4 |

The hydrotreated feed (700° F.+ fraction) is sent to a FCC unit to produce gasoline. The conversion of the fraction 700° F.+ is 80% with the following slate of yields:

| FCC yields (wt % vs. FCC feed) | |
|---|---|
| Fuel gas | 1.8 |
| LPG | 14.6 |
| Gasoline | 58.1 |
| LCO | 14.2 |
| Slurry | 5.3 |
| Coke | 6.0 |

The invention described herein has been disclosed in terms of specific embodiments and applications. However, these details are not meant to be limiting and other embodiments, in light of this teaching, would be obvious to persons skilled in the art. Accordingly, it is to be understood that the drawings and descriptions are illustrative of the principles of the invention, and should not be construed to limit the scope thereof.

We claim:

1. An integrated process for attaining a high degree of vacuum residue conversion, comprising the steps of:

a) feeding a vacuum resid oil feedstock, 90% of said feedstock boiling above 975° F., along with steam stripper bottoms from a downstream steam stripper, to a solvent deasphalter ("SDA") using a $C_4/C_5$solvent to provide an asphaltene stream and a deasphalted oil stream;

b) processing said asphaltene stream through one or more ebullated-bed reactors in series to produce an ebullated-bed reactor product stream;

c) separating said ebullated-bed reactor product stream in a hot high pressure separator to provide a gas phase product and a liquid phase product, d) processing said liquid phase product through a steam stripper to produce a stripper overhead effluent and a stripper bottoms effluent;

e) recycling a portion of the said stripper bottoms effluent for combining with said vacuum resid feedstock from step (a) prior to feeding combined feedstream into said SDA; and f) processing said deasphalted oil stream through a classical fixed-bed reactor for hydrotreatment or hydrocracking wherein steps a-f achieve a residue conversion of greater than 60%.

2. The process of claim 1 wherein steps a-f achieve a residue conversion of greater than 70%.

3. The process of claim 1 wherein steps a-f achieve a residue conversion of greater than 80%.

4. The process of claim 1 wherein steps a-f achieve a asphaltene conversion of greater than 50%.

5. The process of claim 1 wherein more than one ebullated-bed reactor in series is utilized.

6. The method of claim 1 wherein the ebullated-bed unit used to process said asphaltene stream is operated at a total pressure of between 1500 and 3000 psia, a temperature of between 750° F.-850° F., a LHSV of between 0.1 and 1.0 $hr^{-1}$, and a catalyst replacement rate of between 0.1 and 1.0 lbs/bbl.

7. The method of claim 1 wherein the SDA unit utilizes a $C_3$ solvent to separate the heavy residue feedstock into a asphaltene stream and a deasphalted oil stream.

8. The method of claim 1 wherein the SDA unit utilizes a $C_4/C_5$ solvent to separate the heavy residue feedstock into a asphaltene stream and a deasphalted oil stream.

9. The method of claim 1 wherein subsequent to step f), some or all of the stream is sent to a Fluid Catalytic Cracking unit for further processing into diesel and gasoline products.

10. The method of claim 1 wherein subsequent to step f, some or all of the stream is further processed in a dewaxing step.

* * * * *